US009859618B2

(12) United States Patent
Merk

(10) Patent No.: US 9,859,618 B2
(45) Date of Patent: Jan. 2, 2018

(54) RIDGED HORN ANTENNA HAVING ADDITIONAL CORRUGATION

(71) Applicant: Lisa Draexlmaier GmbH, Vilsbiburg (DE)

(72) Inventor: Thomas Merk, Stuttgart (DE)

(73) Assignee: Lisa Draeximaier GmbH, Vilsbiburg (DE)

( * ) Notice: Subject to any disclaimer, the term of this patent is extended or adjusted under 35 U.S.C. 154(b) by 41 days.

(21) Appl. No.: 14/845,391

(22) Filed: Sep. 4, 2015

(65) Prior Publication Data

US 2016/0072190 A1 Mar. 10, 2016

(30) Foreign Application Priority Data

Sep. 5, 2014 (DE) ..... 10 2014 112 825

(51) Int. Cl.
*H01Q 13/02* (2006.01)
*H01Q 1/50* (2006.01)

(52) U.S. Cl.
CPC ..... *H01Q 13/0208* (2013.01); *H01Q 1/50* (2013.01); *H01Q 13/0258* (2013.01); *H01Q 13/0266* (2013.01); *H01Q 13/0275* (2013.01)

(58) Field of Classification Search
CPC ..... H01Q 13/0208; H01Q 13/0216; H01Q 13/0225; H01Q 13/0266; H01Q 13/0275; H01Q 13/02; H01Q 13/06; H01Q 13/065; H01Q 21/0006; H01Q 21/06; H01Q 21/061; H01Q 21/064; H01Q 21/28; H01Q 21/29; H01Q 21/293; H01Q 13/0258
See application file for complete search history.

(56) References Cited

U.S. PATENT DOCUMENTS 404,006 A 5/1889 Kruse
4,040,060 A 8/1977 Kaloi
4,658,258 A * 4/1987 Wilson ..... H01Q 13/0208 343/786

(Continued)

FOREIGN PATENT DOCUMENTS

DE 2152817 A1 4/1972
DE 3146273 A1 5/1983
WO WO 2014005693 A1 1/2014

OTHER PUBLICATIONS

Browne et al, A Novel Design of a Miniature Wideband Corrugated Horn Antenna Employing Unique Sinusoidal Shaped Ridges, 2008, IEEE, pp. 1-4.*

*Primary Examiner* — Tho G Phan
*Assistant Examiner* — Patrick Holecek
(74) *Attorney, Agent, or Firm* — Finnegan, Henderson, Farabow, Garrett & Dunner LLP

(57) ABSTRACT

A radiating element may comprise an antenna element, a radiating element edge, and a corrugation. The antenna element may have an aperture that extends into the antenna element, and an aperture side defining an aperture area of the antenna element. The radiating element edge may surround the antenna element on the aperture side. The corrugation may be configured to separate, at least on the aperture side, the antenna element and the surrounding radiating element edge. The radiating element edge may be connected to the antenna element at a distance greater than zero from the aperture side of the antenna element.

16 Claims, 3 Drawing Sheets

(56) References Cited

U.S. PATENT DOCUMENTS

| | | | | | |
|---|---|---|---|---|---|
| 4,686,537 | A * | 8/1987 | Hidaka | H01Q 13/0241 | 333/21 A |
| 4,897,663 | A | 1/1990 | Kusano et al. | | |
| 5,552,797 | A * | 9/1996 | Cook | H01Q 13/0208 | 343/786 |
| 5,699,072 | A * | 12/1997 | Tokuda | H01Q 1/247 | 343/786 |
| 6,052,099 | A * | 4/2000 | Imaizumi | H01Q 1/247 | 343/775 |
| 6,483,475 | B1 * | 11/2002 | Tokuda | H01Q 1/247 | 343/781 R |
| 9,099,787 | B2 * | 8/2015 | Blech | H01Q 13/06 | |
| 2013/0234904 | A1 * | 9/2013 | Blech | H01Q 13/06 | 343/776 |

* cited by examiner

RIDGED HORN ANTENNA HAVING ADDITIONAL CORRUGATION

CROSS-REFERENCE TO RELATED APPLICATION

This application is based upon and claims the benefit of prior German Application No. 10 2014 112 825.7, filed on Sep. 5, 2014, the entire contents of which are incorporated herein by reference.

TECHNICAL FIELD

The present disclosure relates to a radiating element comprising an antenna, which may be separated from an antenna edge by a corrugation, and may be for antenna systems that support bidirectional satellite communication operated in the Ka, Ku or X band for mobile and aeronautical applications.

BACKGROUND OF THE DISCLOSURE

Demand from passengers on airplanes for multimedia services is on the rise, requiring airplanes to be wirelessly connected to terrestrial data sources or communication networks. Wireless broadband channels for transmitting data at very high data rates may be needed to connect airplanes to a satellite network for the transmission of multimedia data. For this purpose, antennas having small dimensions may be installed on airplanes so as to be installed beneath a radome, but nonetheless satisfy extreme requirements in regard to the sending characteristics for directional wireless data communication with the satellite (such as in the Ku, Ka or X band) because interference from neighboring satellites must be reliably precluded.

The antenna may be movable beneath the radome so as to track the orientation at the satellite when the airplane is moving. The antenna may be be lightweight so as to cause only little additional fuel consumption of the airplane.

The regulatory requirements in regard to sending operations are derived from international standards. These regulatory guidelines are intended to ensure that no interference of neighboring satellites can take place in the directional sending operation of a mobile antenna that is mounted on the airplane and sending to a satellite.

Approaches for compact antennas for aeronautical satellite communication are shown in WO 2014005693, for example, describing ridged horn antennas as single radiating elements. These single radiating elements are arranged in an antenna array and fed high-frequency signals via suitable feed networks. According to WO 2014005693, steps within the ridged horn antenna are used to improve matching of the ridged horn antenna to the free space. However, these steps may result in an increased height.

Alternative designs of single radiating elements are described in DE 3146273, DE 2152817 and U.S. Pat. No. 4,040,060, with corrugations being introduced into walls of a horn antenna so as to increase the bandwidth of the horn antenna. The corrugations are introduced successively in concentric rings into an edge of the horn antenna for this purpose. U.S. Pat. No. 4,897,663A shows a horn antenna comprising multiple corrugations (chokes), which may be suitable for optimizing the directivity of the single radiating elements for multiple frequencies. These measures may not reduce height.

SUMMARY

Embodiments of the present disclosure may provide a single radiating element that supports a broad frequency range and has a small height and good matching.

Embodiments may include a single radiating element and may include an antenna. Other embodiments are disclosed throughout the disclosure.

A radiating element according to the present disclosure may comprise an antenna element, which may be a ridged horn antenna. The antenna element may have an aperture side, and an aperture that extends into the antenna element. The aperture side may define an aperture area of the antenna element. The antenna element may be surrounded by a radiating element edge, and may be surrounded on the aperture side by the radiating edge. A corrugation may be configured to separate, at least on the aperture side, the antenna element and the surrounding radiating element edge. The radiating element edge may be connected to the antenna element of the radiating element at a distance greater than zero from the aperture side. Multiple such radiating elements may be suitable for forming an antenna if they are arranged next to each other, wherein neighboring radiating elements then have a shared single radiating element edge.

The single radiating element according to the present disclosure may comprise a ridged horn antenna, which on aperture side may be surrounded by a single radiating element edge separated from the ridged horn antenna by a corrugation. The single radiating element edge may be connected to the single radiating element at a distance from the aperture area. Multiple such single radiating elements may be suitable for forming an antenna if they are arranged next to each other, wherein neighboring single radiating elements then have a shared single radiating element edge.

Ridges (constrictions) of the ridged horn antenna may lower the cut-off frequency so that size can be reduced for signals having wavelengths that are predefined by the satellite communication. The corrugation may improve matching and may reduce undesirable cross polarization. This arrangement can result in a superimposition of a wave from the ridged horn antenna and the wave from the corrugation, with the corrugation being dimensioned so that an incoming wave into the corrugation which is reflected at a corrugation end structurally superimposes on a wave emerging from the ridged horn antenna.

In antennas composed of many single radiating elements for satellite communication on vehicles, the installation space for the single radiating element may be automatically limited in the plane of the aperture, and also in the depth. The single radiating elements may therefore be as small as possible. In certain embodiments, the introduction of corrugations may be a disadvantage because installation space for the single radiating element apertures may be lost due to the corrugations in the aperture plane, and the single radiating element aperture may become smaller. Smaller single radiating element apertures, in turn, can mean a higher cut-off frequency, which can cause lower bandwidth. Embodiments of the ridged horn antennas according to the present disclosure are advantageous to remedy this situation because the bandwidth may be broadened again. The corrugations can be used according to the present disclosure to reduce the installation space for particular matching, making the antenna flatter, or to improve matching for a particular installation depth.

In certain embodiments, the single radiating element edge may advantageously have a rectangular contour, in the center of which the ridged horn antenna is arranged. In this way, multiple such single radiating elements can be easily combined without loss of space. A square contour of the single radiating element edge simplifies this combination in both directions. With a centered arrangement of the ridged horn antenna, the radiation pattern may be oriented toward the center of the single radiating element. When considering that a slight inclination of the radiation pattern to the side of electric field incoupling may be compensated for in the case of electric field incoupling, the arrangement of the ridged horn antenna may also be slightly offset from the center.

According to a further embodiments, the corrugation may have substantially perpendicular walls in relation to the aperture area, where corrugations open directly to the aperture area and avoid an inclination, which would otherwise result in increased space requirement parallel to the aperture area.

The number of required ridges may be dependent on the number of polarizations that are supported. The ridged horn antenna may comprise at least two ridges (four in the case of two polarizations), which are each oriented to the ridged horn antenna center and arranged crosswise. The arrangement may be generally symmetrical, so that an angular distance between two ridges is 180° or 90°.

So as to shift undesirable resonances of the radiated emission of the corrugation with the radiated emission of the ridged horn antenna into a frequency range that is not used, according to embodiments of the present disclosure, a contour of the ridged horn antenna may comprise on the groove side ridges (in the direction of the corrugation, for example) which may influence a volume and a peripheral edge length of the corrugation. These groove-side ridges may be easy to create. The wider the corrugation is dimensioned, the larger may be the supported bandwidth; however, the risk of parasitic modes can increase. An overall width of the ridged horn antenna and the corrugation may be limited by the wavelength of the highest supported frequency that is to be supported.

If the corrugation of the single radiating element is not sufficient to bring about the desired matching, the ridged horn antenna may be provided with a matching step. However, the number of matching steps may be reduced over a comparable ridged horn antenna having no corrugation.

Good matching may be achieved when the distance between the aperture area and the connection of the single radiating element edge and the ridged horn antenna is approximately ¼ λ, wherein λ refers to a center frequency in a used frequency band.

When two polarizations are used, they can be frequency-selectively separated from each other when a stepped corrugation is used. For each polarization, the corrugation can be set to the respective optimal λ/4 of the particular center frequency. This means that the distance between the short circuit of the corrugation and the aperture area can vary along the corrugation. This distance may be the same on opposing sides of the single radiating element edge.

The matching step of the ridged horn antenna may be formed at approximately the same distance from the aperture area as the connection of the single radiating element edge and the ridged horn antenna by way of, for example, milling into a profiled aluminum section. This may simplify production when a matching step is used. This distance may therefore correspond to a thickness of a profiled aluminum section to which a separately produced profiled aluminum section having additional structures of the single radiating element connects.

A microstrip may be used to couple signals into the ridged horn antenna, where two microstrips may be used when two polarizations are supported. Said microstrips may be coupling signal components that are vertically polarized with respect to each other into the ridged horn antenna. The location of the microstrips may in turn predefine the transition between two profiled aluminum sections.

Incoupling may furthermore be facilitated in a space-saving manner in that the short-circuited end of the ridged horn antenna may have a ridge that is aligned with a polarization and may have a predefined ridge length. In this way, different short-circuited ends can be created for the two polarizations, wherein the distance of the two microstrips perpendicularly to the aperture area may correspond to the ridge length, and the distance between the one microstrip and the short-circuited end of the ridged horn antenna, and the distance between the other microstrip and the ridge, each may correspond to λ/4.

The cut-off frequency or the height can be additionally lowered. However, losses may be tolerated when the ridged horn antenna is filled with a dielectric. The corrugation can additionally also be filled with a dielectric.

By combining multiple such single radiating elements arranged next to each other, an antenna according to the present disclosure comprising multiple single radiating elements may be created, wherein the single radiating elements can be fed via a microstrip network.

The antenna may therefore be suitable for a bidirectional operation in vehicle-based satellite communication in a frequency band from 7.25 to 8.4 GHz (X band), 12 to 18 GHz (Ku band), and 27 to 40 GHz (Ka band).

Further advantages and features of the present disclosure will be apparent from the following description of embodiments. The features described in the present disclosure can be implemented alone or in combination. The following description of the embodiments is made with reference to the accompanying drawings.

DETAILED DESCRIPTION

Figure 1:
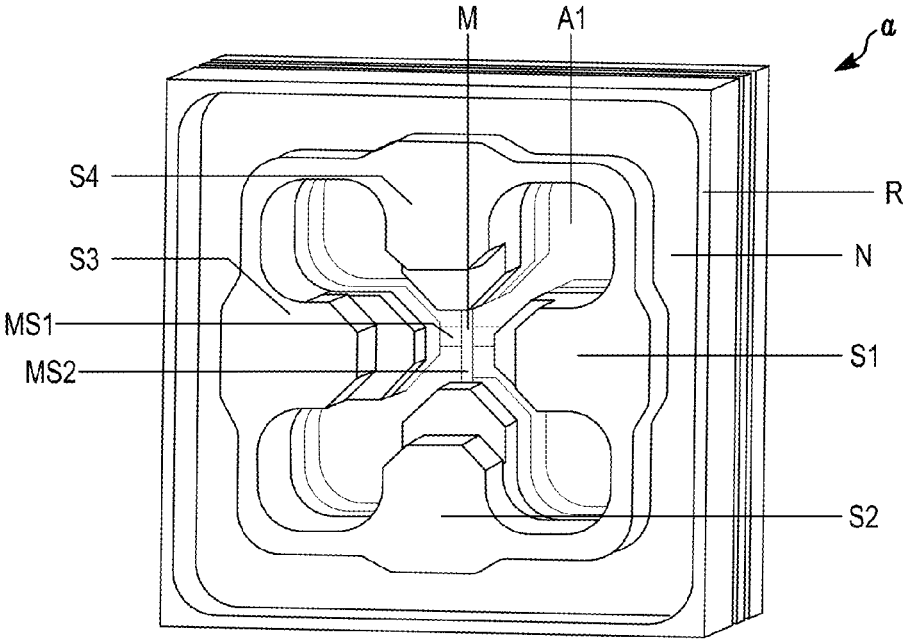
FIG. 1 shows a top view onto a single radiating element according to an embodiment of the present disclosure.

FIG. 1 shows a single radiating element having a square contour, which may be formed by a horn antenna edge R, according to an embodiment of the present disclosure. A ridged horn antenna A1 may be arranged centrally within the contour of the single radiating element. The ridged horn antenna A1 itself may have a substantially square shape with slightly rounded corners and curvatures, which will be described hereafter in the embodiment according to FIG. 4. The ridged horn antenna A1 may be separated from the horn antenna edge R by a corrugation N, which itself can have a substantially square shape and, like the ridged horn antenna A1, can be filled with air. Surfaces of the ridged horn antenna A1, the corrugation N, and the horn antenna edge R may form the aperture area a.

The ridged horn antenna A1 can be characterized by four ridges S1 to S4, which may be arranged crosswise and in the direction of a ridged horn antenna center M. The single radiating element may therefore be able to support two polarizations located perpendicularly on each other. Each of the two ridge pairs S1 and S3, and S2 and S4, formed from two opposing ridges, can support one polarization. As is additionally described in FIG. 2, two microstrips MS1 and MS2 may be located in the interior of the ridged horn antenna A1, may couple high-frequency signals into the ridged horn antenna A1 when sending takes place, and may couple the signals out of the ridged horn antenna A1 when receiving takes place.

A radiation pattern of the single radiating element may be formed by the superimposition of signals of the ridged horn antenna A1 and the corrugation N, as described hereafter. A portion of the signal leaving the ridged horn antenna A1 can be coupled into the corrugation N. At a corrugation depth of $\lambda/4$, with $\lambda$ being the wavelength of the signal (in the case of broadband signals, approximately the center frequency of the bandwidth), the signal in the corrugation N can traverse 90° to the end of the corrugation N, can be rotated 180° at the end of the corrugation N by a short circuit (zero point), and can traverse the 90° back again to the aperture area a, where the signal may be added at 360° in phase to the signal from the ridged horn antenna A1. This may create a standing wave in the corrugation N.

Figure 2:
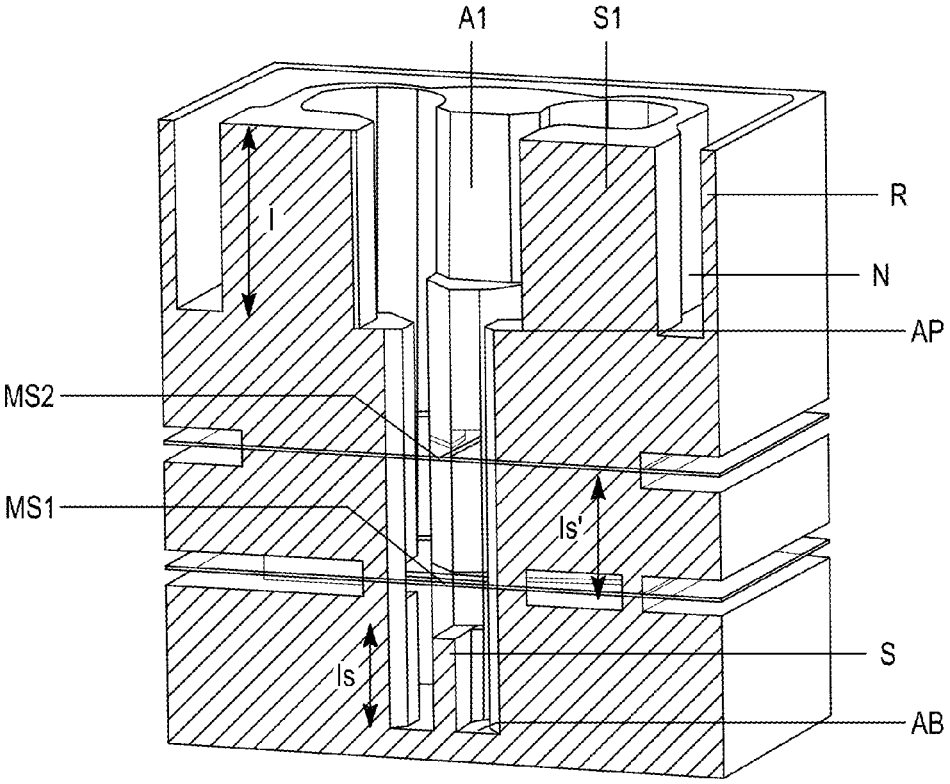
FIG. 2 shows a sectional view of a single radiating element according to an embodiment of the present disclosure.

An embodiment of the single radiating element according to the present disclosure is shown in 3D form in FIG. 2, with the structures of the ridged horn antenna A1, corrugation N, and horn antenna edge R located perpendicularly on the aperture area. There may be a distance I between the connection of the ridged horn antenna A1 and horn antenna edge R forming the termination (short circuit) of the corrugation N and the aperture area a. The distance 1 may correspond approximately to $\lambda/4$. A matching step AP may be arranged within the ridged horn antenna A1 at approximately the same height as the depth (termination) of the corrugation N, with said ridged horn antenna A1 being further constricted in this step. Only one matching step AP may be provided in this ridged horn antenna.

Lateral openings, through which the microstrips MS1, MS2 may be guided, may be introduced into the horn antenna edge R. The microstrips MS1, MS2 may be arranged parallel to the aperture area and perpendicularly to each other, and may be spaced from each other in the direction of the aperture area. The distance 1s' between the microstrips MS1, MS2 may correspond to a length Is of an additional ridge S, which may be arranged at a short-circuited end AB of the ridged horn antenna A1 and may extend from there into the ridged horn antenna A1. The ridge S may be oriented so that it serves as a ridged horn antenna termination for the one of the polarizations. The microstrips MS1, MS2 may therefore each be arranged $\lambda/4$ from the ridge S or the short-circuited end AB of the ridged horn antenna A1.

The microstrips MS1, MS2 may be composed of a suspended stripline (SSL), which may be made of a printed circuit board to which a copper strip (copper layer) is applied. The printed circuit board itself may be made of a dielectric having a thickness of 0.1 to 1 millimeters (mm), for example 0.127 mm. The copper strip located thereon may have a width of 0.3 to 1 mm, for example 0.5 mm, and may have a thickness of 15 to 20 micrometers (μm), for example 17.5 μm. The openings at the level of the incoupling may be shaped as narrow slots and may be adapted to the shape of the microstrip MS1, MS2 to allow the microstrips MS1, MS2 to protrude into the ridged horn antenna A1. The SSL may be surrounded by metal; therefore, there may be no power losses due to radiated emission out of the structure and as a result of the feedthrough at the slots. By appropriately dimensioning the slots, an interference effect on a field in the ridged horn antenna A1 may also remain negligible.

Figure 3:
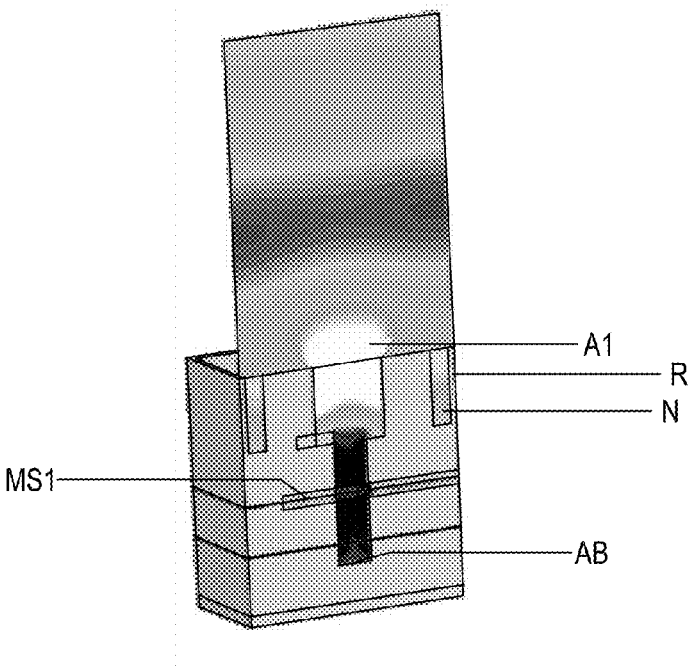
FIG. 3 shows an electric field distribution of a single radiating element in an antenna comprising periodically arranged single radiating elements.

FIG. 3 shows a simulated electric field distribution of the single radiating element of an antenna according to embodiments of the present disclosure, which may be composed of multiple single radiating elements in a periodic arrangement. The signals may be coupled into the ridged horn antenna A1 by the microstrip MS1 and reflected at the short-circuited end AB of the ridged horn antenna A1. The corrugation N may act as a reflector for the signal from the ridged horn antenna A1. Both the fields from the radiating ridged horn antenna A1, and the reflected components from the corrugation N, may be added to form a plane wavefront.

Figure 4:
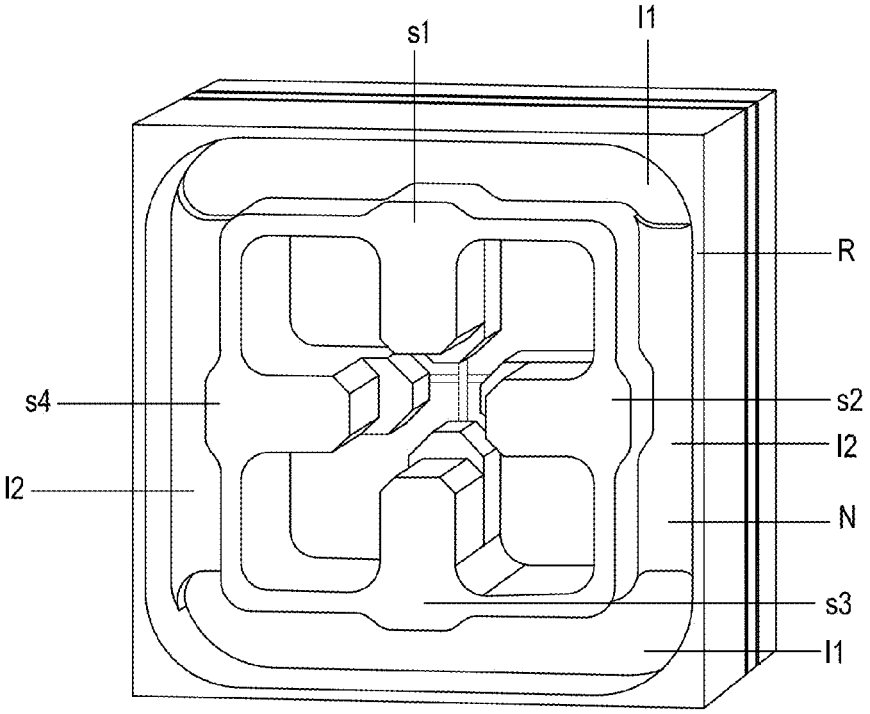
FIG. 4 shows a top view onto an alternative single radiating element according to an embodiment of the present disclosure.

FIG. 4 shows an alternative single radiating element according to embodiments of the present disclosure. This single radiating element may be used for antennas having circular polarization (using a meander-line polarizer) in the X band. For example, Rx may be 7.25 GHz to 7.75 GHz (LHCP), and Tx may be 7.90 GHz to 8.40 GHz (RHCP).

The corrugation depth I1, I2 may vary. Opposing sections of the corrugation N may have the same depth I1 or I2. Depth I1 or I2 may be dimensioned as a function of the polarization supported by the neighboring sections of the horn antenna edge R. The stepped corrugation N may allow the two polarizations to be optimally matched frequency-selectively separate from each other. For each polarization, the corrugation N may be set to the different optimal $\lambda/4$. The single radiating element according to FIG. 4 moreover may comprise groove-side ridges s1 to s4, which may protrude from the ridged horn antenna in the direction of the corrugation N and may result in changes of the width of the corrugation N. In this way, undesirable resonances between modes of the waves from the ridged horn antenna and corrugation N may be shifted into frequency ranges in which the antenna is not operated.

Figure 5:
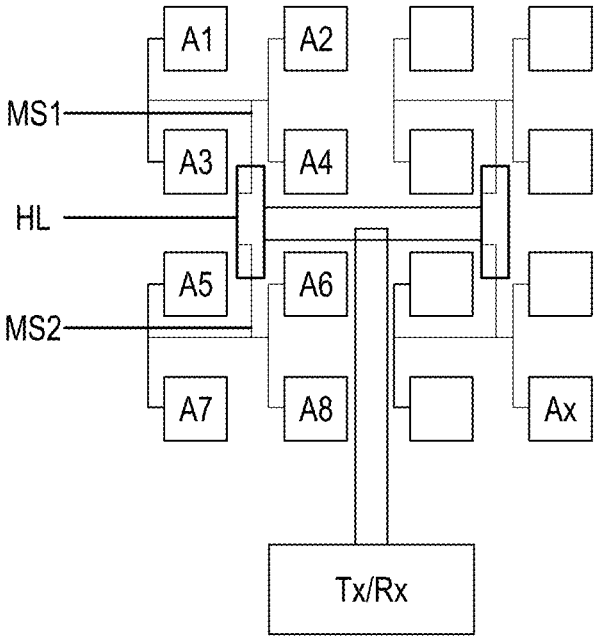
FIG. 5 shows an antenna comprising multiple single radiating elements and a feed network.

The single radiating element according to embodiments of the present disclosure may be used in antennas comprising multiple single radiating elements, which may be arranged in a shared aperture area. FIG. 5 shows an antenna comprising 16 single radiating elements. A feed network may be composed of microstrips MS1 and MS2, which can feed 8 single radiating elements A1 to A8. A waveguide HL may be arranged centrally within eight single radiating elements A1 to A8, and the signals may be coupled out in two microstrips MS1 and MS2 at the two narrow sides of the waveguide HL. These microstrips MS1 and MS2 in turn may form microstrip networks, which may connect 4 single radiating elements A1 to A4, or AS to A8, to the waveguide HL. The waveguide HL, in turn, may form the terminal of a waveguide network. Waveguide power splitters may be provided. The waveguide network, in turn, may be connected to a transceiver device Tx/Rx, which may receive corresponding signals from the antenna, or send signals to the antenna.

The feed network having dual magnetic field incoupling may allow a large number of antenna elements to be fed with a minimum of power splitters in the waveguide network.

By way of such feeding and using single radiating elements according to the present disclosure, light-weight compact antennas can be implemented.

LIST OF REFERENCE NUMERALS

Aperture area a
Microstrip MS1, MS2
Ridged horn antenna A1, A2 to Ax
Short-circuited end of ridged horn antenna AB
Transceiver devices Tx/Rx
Horn antenna edge R
Corrugation N
Depth of the corrugation I,I1,I2
Ridges of ridged horn antenna S1 to S4
Ridged horn antenna center M
Matching step AP
Waveguide HL
Ridge at ridged horn antenna end S
Ridge length Is
Distance of the microstrips Is'
Groove-side ridges s1 to s4

What is claimed is:

1. A radiating element for an antenna system comprising:
an antenna element having an aperture that extends into the antenna element, wherein the antenna element includes:
an aperture side defining an aperture area of the antenna element; and
at least two ridges which are each oriented about a center of the antenna element and are arranged in crosswise orientation with respect to the center of the antenna element;
a radiating element edge defining a rectangular contour that surrounds the antenna element on the aperture side; and
a single corrugation configured to separate, at least on the aperture side, the antenna element and the surrounding radiating element edge;
wherein:
the radiating element edge is connected to the antenna element at a distance greater than zero from the aperture side of the antenna element;
a width of the radiating element is less than λ, where λ is a wavelength of a center frequency in a used frequency band; and
the antenna element is centrally arranged within the contour.

2. The radiating element according to claim 1, wherein the corrugation has walls substantially perpendicular to the aperture area.

3. The radiating element according to claim 1, wherein the radiating element edge defines a square contour of the radiating element.

4. The radiating element according to claim 1, wherein a contour of the antenna element comprises ridges on a groove side pointing away from a center of the antenna element.

5. The radiating element according to claim 1, wherein the antenna element comprises a matching step.

6. The radiating element according to claim 5, wherein the matching step of the antenna element is formed at a same distance from the aperture area as from a connection of the radiating element edge and the antenna element.

7. The radiating element according to claim 1, wherein a distance between the aperture area and a connection of the radiating element edge and the antenna element is λ/4, where λ is a wavelength of a center frequency in a used frequency band.

8. The radiating element according to claim 1, wherein a distance between the aperture area and a connection of the radiating element edge and the antenna element varies along the corrugation.

9. The radiating element according to claim 8, wherein the distance is the same on opposing sides of the radiating element edge.

10. The radiating element according to claim 1, further comprising:
a microstrip configured to couple signals into the antenna element.

11. The radiating element according to claim 1, further comprising:
two microstrips configured to couple signal components into the antenna element, wherein the signal components are orthogonally polarized with respect to each other.

12. The radiating element according to claim 11, wherein:
a short-circuited end of the antenna element has a ridge that is aligned with a polarization and has a ridge length;
a distance between the two microstrips approximately equals the ridge length; and
a distance between one of the two microstrips and the short-circuited end, and a distance between another one of the two microstrips and the ridge, each approximately equals λ/4, where λ is a wavelength of a center frequency in a used frequency band.

13. The radiating element according to claim 1, wherein the antenna element is filled with a dielectric.

14. An antenna system comprising:
a plurality of radiating elements, each of the radiating elements comprising:
an antenna element having an aperture that extends into the antenna element, wherein the antenna element includes:
an aperture side defining an aperture area of the antenna element; and
at least two ridges which are each oriented about a center of the antenna element and are arranged in crosswise orientation with respect to the center of the antenna element;
a radiating element edge that surrounds the antenna element on the aperture side; and
a single corrugation configured to separate, at least on the aperture side, the antenna element and the surrounding radiating element edge;
wherein:
the radiating element edge is connected to the antenna element at a distance greater than zero from the aperture side of the antenna element; and
a width of the radiating element is less than λ, where λ is a wavelength of a center frequency in a used frequency band; and
a microstrip network configured to feed signals to radiating elements, wherein neighboring single radiating elements have a shared edge.

15. The antenna system according to claim 14, wherein the antenna system is configured to operate bidirectionally in vehicle-based satellite communication in at least one of an X, Ka, or Ku band.

16. A radiating element for an antenna system comprising:
an antenna element comprising a short-circuited end and an aperture extending into the antenna element, wherein the antenna element has an aperture side defining an aperture area of the antenna element;

a radiating element edge that surrounds the antenna element on the aperture side; and a corrugation configured to separate, at least on the aperture side, the antenna element and the surrounding radiating element edge; and two microstrips configured to couple signal components into the antenna element, wherein the signal components are orthogonally polarized with respect to each other wherein:

the radiating element edge is connected to the antenna element at a distance greater than zero from the aperture side of the antenna element;

the short-circuited end has a ridge having a ridge length, the ridge being aligned with a polarization;

a distance between the two microstrips approximately equals the ridge length; and a distance between one of the two microstrips and the short-circuited end, and a distance between another one of the two microstrips and the ridge, each approximately equals $\lambda/4$, where $\lambda$ is a wavelength of a center frequency in a used frequency band.

* * * * *